US006050422A

United States Patent [19]

Peters et al.

[11] Patent Number: 6,050,422

[45] Date of Patent: Apr. 18, 2000

[54] ROTARY SWEEP SCALPER

[75] Inventors: Michael L. Peters, Hampton; Mark W. Saltus, Henderson, both of Nebr.

[73] Assignee: GSI Group, Inc., Assumption, Ill.

[21] Appl. No.: 08/804,405

[22] Filed: Feb. 21, 1997

[51] Int. Cl.[7] ..... B07B 1/04

[52] U.S. Cl. ..... 209/352; 209/389

[58] Field of Search ..... 209/352, 385, 209/386, 389, 390, 240, 243, 254, 255

[56] References Cited

U.S. PATENT DOCUMENTS

| | | | |
|---|---|---|---|
| 456,584 | 7/1891 | Morse | 209/390 X |
| 493,521 | 3/1893 | Rishworth et al. | 209/385 X |
| 2,347,716 | 5/1944 | Staege | 209/389 X |
| 2,682,811 | 7/1954 | Infanger | 209/389 X |
| 2,727,441 | 12/1955 | Cram | 209/352 |
| 3,159,572 | 12/1964 | Ranhagen | 209/389 X |
| 3,469,688 | 9/1969 | Stallman | 242/84.1 |
| 3,752,315 | 8/1973 | Hubach | 254/266 |
| 4,231,861 | 11/1980 | Hannie et al. | 254/344 |
| 4,376,044 | 3/1983 | Ditzenberger | 209/389 X |
| 4,543,181 | 9/1985 | Greenwood | 209/389 X |
| 5,123,542 | 6/1992 | Hoppe | 74/545 |
| 5,605,233 | 2/1997 | Hauch | 209/389 X |

FOREIGN PATENT DOCUMENTS

| | | | |
|---|---|---|---|
| 1461529 | 2/1989 | U.S.S.R. | 209/390 |
| 1465132 | 3/1989 | U.S.S.R. | 209/389 |

*Primary Examiner*—Robert P. Olszewski
*Assistant Examiner*—Steven B. McAllister
*Attorney, Agent, or Firm*—Polster, Lieder, Woodruff & Lucchesi, L.C.

[57] ABSTRACT

A rotary sweep scalper for cleaning grains deposited within a hopper. Grains to be processed are deposited through an upper inlet opening in the hopper and fall unto a screen located below. Those grains below a predetermined size pass through the screen to the hopper's lower discharge opening. A drive moves impeller arms located above the screen in the hopper to either force particles below a specified size through the screen or to discharge large particles through the hopper's side discharge opening. These movable impeller arms may be of different sizes and be spaced at different locations above the screen. Actual contact with the grain may be through a flexible flap attached to the lower edge of the impeller arms.

14 Claims, 1 Drawing Sheet

ROTARY SWEEP SCALPER

BACKGROUND OF THE INVENTION

Over the years many devices have been developed to prepare grain. In some cases export considerations dictate that the picked grain product (e.g., corn) be scalped to separate its parts that support the undesired portion from the desirable grain portion. For example, corn infested with the European Corn Borer Larva needs to be scalped before export to insure that the stalks, cobs and large refuse (usually over ½ inch in size) where the larva lives, are separated from the exportable residual grain. Presently such scalpers require U.S. Department of Agriculture (USDA) approval before they can be used and are designed to operate either by using a gravity feed, vibration, drag type, aeration or a combination thereof combined with a filtering screen. Most such units are limited to processing no more than 15,000 bushels per hour of corn. The present improved scalper invention differs from such earlier separation methods by combining a rotary sweep with a screen to provide the desired scalper operation at an increased speed (40,000 bushels per hour or more over a ½ inch screen) with a more reliable operation and less expensive installation and operating cost. This increase in reliability is attributed to the use of fewer moving parts to perform the scalper operation at a greater speed.

DESCRIPTION OF THE PRIOR ART

Grain scalpers are known in the prior art. For example, U.S. Pat. No. 3,469,688 to Staliman shows such a unit which utilizes a controlled feed, vibrating belts, and air streams to bring about the desired separation.

In the U.S. Pat. No. 3,752,315 to Hubach a combination of gravity feed and vibration is used to separate the grains.

Further, in the grain cleaning apparatus described in U.S. Pat. No. 4,231,861 to Hannie et al., a gravity screener is used without the use of mechanical motion to enhance the process thus providing for a limited capacity unit.

And in U.S. Pat. No. 5,123,542 to Hoppe a cleaner, spreader and aeration system is used to clean and spread grain before it enters a grain storage bin. It thus is used for a different purpose and uses no moving or rotary arms to maintain the grain in contact with a screen. In contrast to the prior art, the present invention uses rotatable impeller arms which maintain the grain in contact with a screen to force it through the screen as more further set forth in this specification.

SUMMARY OF THE INVENTION

This invention relates to a grain scalper having an inlet opening with a driven impeller assembly and a lower screen. Grain fed from above the impeller is maintained in contact with a screen located below the impeller. Undesirable separated grain product components are either discharged before passing through the screen or are separated into smaller units before passing through the screen. After screening occurs, the cleaned grain is discharged through an outlet opening.

It is the primary object of the present invention to provide for an improved grain scalper.

Another object is to provide for such a scalper having few moving part thus providing for greater reliability in its operation with an increased grain processing volume.

These and other objects and advantages of the present invention will become apparent to readers from a consideration of the ensuing description and the accompanying drawings.

DESCRIPTION OF THE PREFERRED EMBODIMENT

Figure 1:
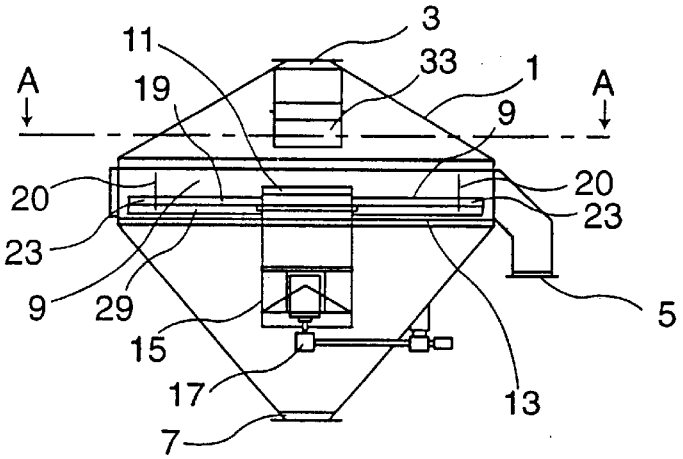
FIG. 1 is a front cross sectional view of the invention's preferred embodiment.

FIG. 1 is a front cross sectional view of the invention's preferred embodiment. The generally closed circular in cross section hopper housing 1 has a top adjustable inlet assembly 3, a side discharge opening 5 and a lower cleaned product discharge opening 7. Within the hopper are the driven impeller assembly 9 used to move the grain deposited from upper inlet assembly 3; the circular drive tube assembly 11; the screen deck assembly 13 located below the impeller assembly; the still lower bypass gate assembly 15; and the conventional electric powered motor drive assembly 17.

Figure 2:
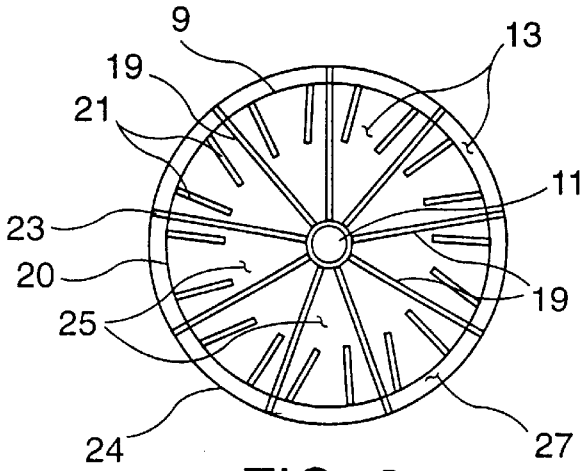
FIG. 2 is a top sectional view of the FIG. 1 embodiment.

FIG. 2 is a top sectional view of the FIG. 1 embodiment showing its internal working as viewed downwardly in the direction of the arrows A—A. The impeller assembly 9 consists of several radially separated primary impeller arms 19 (eight shown in this embodiment); the circular steel six inch vertical inner ring 20 over the screen deck 13 with its lower attached screen engaging urethane flap; eighteen spaced smaller secondary arms 21 located each with a screen engaging urethane flap around the central inlet opening 3 along its outer periphery and attached to movable inner ring 20; and tertiary impeller arms 23 (nine shown) located outside of raised inner ring 20 between it and the raised larger diameter stationary outer ring surface 24.

Impeller arms 19 are attached to and extend from the hub of the circular drive assembly 11 to ring 20 and move with their rotation. The number of impeller arms 19 vary with the size of the unit; four for a small unit and ten for a large unit. The primary separation area 25 is located nearer the circular hopper's center.

The secondary separation area 27 resides near the screen deck assembly's (13) outer periphery, allowing maximum separation opportunity for the product being cleaned. The eighteen spaced smaller secondary arms 21 provide structural support for the arms 19 and keep the grain within the center of the screen deck 13. Arms 21 are used to spread out the grain and add to the efficiency of keeping grain in the contact with the lower screen deck 13. Any grain or refuse that floats over the raised inner ring 20 reaches the outer secondary section between the rings where the tertiary arms 23 sweep it around one more pass before depositing it in the discharge chute. In operation, both the primary impeller arms 19 and secondary impeller arms 21 rotate in unison above the lower screen deck 13 sweeping grain across the screen. The tertiary impeller arms 23 are really extensions of the impeller arms 19 and also have lower urethane flaps used to sweep the grain over the screen before it is deposited into the discharge chute.

Figure 3:
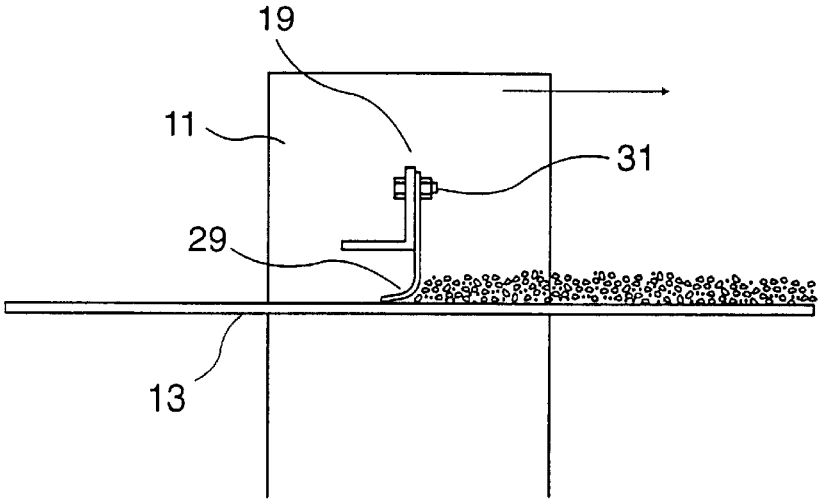
FIG. 3 shows a side view of a primary impeller arm moving grain.

FIG. 3 shows a side view of one the primary impeller arms 19 moving grain resting on the lower screen deck 13. The impeller arm 19 is attached to and radially extends from the rotating center hub drive tube assembly 11 such that it moves in unison with the rotatable tube assembly.

Below the arm 19 is a flexible urethane flap 29 attached to the arm's lower edge which rides on the surface of the lower screen deck 13. A conventional nut and bolt arrangement 31 attaches the flap along its length to the moving impeller arm 19. A similar urethane flap is attached to lower side of ring 20 and the tertiary arm 23 to move the grain on the screen.

Initially grain is fed though the adjustable inlet assembly 3 to enter the interior of the generally closed hopper 1. Control of the grain flow is accomplished by lowering or raising the inlet spout 33 in the inlet assembly 3 to produce even feed at the desired rate. Thus, lowering the spout decreases the flow while raising it increases the grain feed rate.

The drive assembly 17 is used to rotatably move the drive tube assembly and its attached impeller arms 19 and 23. When the drive assembly is engaged the bypass gate assembly 15 automatically closes and the deposited material is delivered to the screen deck assembly 13.

The impeller assembly 9 with its system of blades spreads the deposited material over the screen deck assembly to permit its separation thereon. The screen is horizontal or slightly inclined as required for the properties of the material involved. Most of the material is separated in the primary separation area 25 by this action. Both the force of gravity and the action of the moving impeller arms force the grain though the screen's openings (usually about ½ inch square).

The cleaned or "scalped" product continues on down the hopper where it is discharged through the cleaned product discharge opening 7. Material too large to fit through the screen continues out to the secondary separation area 27 beyond the ring 20 where it engages the tertiary impeller arms 23 to move it to the discharge location 5 (see FIG. 1) by which it exits the hopper unit.

Clearly, there is a minimum of moving parts since only the rotating impeller assembly aided by the action of gravity are needed to move the grain over the screen. When corn is processed only pieces below a specified larger dimension (½ inch) will pass through the screen to the opening 7. These small sized corn component pieces are too small to support the undesired larva. Thus, the larva are neither either discharged to opening 5 or are unable to survive if passed through opening 7.

Once the scalping operation is completed, the drive assembly 17 is momentarily reversed and the bypass gate assembly 15 opens automatically. In this mode material deposited in the opening 3 is passed through the opened drive tube assembly 11 and is discharged unscalped by way of the bypass gate assembly 15 to the lower hopper, completely by-passing the screen media 13, where it will exit the unit through the discharge exit 7.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A grain scalper for separating grain, said grain comprising grain particles and refuse desirably separated from said grain particles; said grain scalper comprising:

a hopper having a top inlet for the introduction of grain to be scalped, a side discharge for the discharge of said refuse, and a lower discharge outlet for the discharge of said scalped grain particles;

a screen within said hopper positioned above said lower discharge outlet and below said top inlet with said side discharge outlet being at the approximate elevation of said screen, said screen having a multiplicity of screen openings therein of predetermined size that permit grain particles smaller than said openings to pass therethrough and to said hopper's lower discharge opening but that block the passage of said refuse;

a rotary driven impeller within said hopper mounted for rotation about a vertical axis, said impeller having a plurality of arms of different lengths attached to a ring generally concentric about said vertical axis, said arms extending radially outwardly from said vertical axis with said arms disposed above said screen, at least one of said arms having a lower flexible flap which cooperates with the screen to enlarge and move a layer of grain particles and refuse on the upper surface of said screen as said arms rotate above said screen so as to facilitate the passage of the grain particles through said screen openings and for sweeping said refuse radially outwardly of said screen toward said side discharge outlet for discharge therefrom; and a driver which rotatably drives said impeller.

2. The invention as claimed in claim 1, wherein said screen is generally circular upper face over which said impeller arms and flaps are mounted.

3. The invention as claimed in claim 2, wherein said impeller is rotatable driven about said vertical axis and said impeller arms are swept over the screen by an electrically driven motor operatively associated with said assembly.

4. A rotary grain scalper as set forth in claim 1 wherein said impeller has at least one arm of a length so as to extend radially outwardly toward the wall of said housing such that said at least one arm sweeps substantially the entire upper surface of said screen.

5. A rotary grain scalper as set forth in claim 2 wherein said impeller further has a second arm shorter than said at least one arm.

6. A rotary grain scalper as set forth in claim 1 wherein said screen is substantially horizontally disposed within said housing.

7. A rotary grain scalper as set forth in claim 1 wherein said screen has a somewhat conical vertical cross section with the center portion being higher than the outer periphery of said screen.

8. The rotary gram scalper of claim 1 wherein said arms include a first set of arms extending radially between said vertical axis and said ring; and a second set of shorter arms extending inwardly from said ring.

9. The rotary grain scalper of claim 8 wherein the impeller includes a third set of arms extending beyond said ring.

10. The rotary grain scalper of claim 9 wherein said arms of said third set of arms are extensions of said arms of said first set of arms.

11. A grain scalper for separating grain, said grain comprising grain particles and refuse desirably separated from said grain particles; said grain scalper comprising:

a hopper having a top inlet for the introduction of grain to be scalped, a side discharge for the discharge of said refuse, and a lower discharge outlet for the discharge of said scalped grain particles;

a screen within said hopper positioned above said lower discharge outlet and below said top inlet, said screen having a multiplicity of screen openings therein of predetermined size to permit grain particles smaller than said openings to pass through said screen and to said hopper's lower discharge opening but which block the passage of said refuse through said screen;

a rotary driven impeller assembly within said hopper and mounted for rotation about a vertical axis, said inpeller assembly having a plurality of arms attached to a ring generally concentric about said vertical axis, said arms extending radially outwardly from said vertical axis with said arms disposed above said screen, at least one of said arms engaging the screen to move a layer of grain particles and refuse on the upper surface of said screen as said arms rotate to facilitate the passage of the grain particles through said screen openings and for sweeping said refuse radially outwardly of said screen toward said side discharge outlet for discharge therefrom; and a driver for rotatably driving said impeller.

12. The rotary grain scalper of claim 11 wherein at least one of said arms has a lower flexible flap which engages with the screen.

13. The rotary grain scalper of claim 11 wherein said arms of said impeller assembly include a first set of arms and a second set of arms, said second set of arms being shorter than said first set.

14. The rotary grain scalper of claim 13 wherein said first set of arms extend between said vertical axis and said ring and said second set of arms extend inwardly from said ring.

* * * * *

UNITED STATES PATENT AND TRADEMARK OFFICE

CERTIFICATE OF CORRECTION

PATENT NO : 6,050,422

DATED : April 18, 2000

INVENTOR(S) : Peters et al.

It is certified that error appears in the above-identified patent and that said Letters Patent are hereby corrected as shown below:

Col. 4, Line 15, Claim 1
Replace "enlarge" with -- engage

Col. 4, Line 27, Claim 3
Replace "rotable" with -- rotatably

Col. 4, Line 35, Claim 5
Replace "Claim 2" with -- Claim 4

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*